US007077088B1

(12) United States Patent
Decuir, Jr.

(10) Patent No.: US 7,077,088 B1
(45) Date of Patent: Jul. 18, 2006

(54) DESMODROMIC VALVE RETROFIT SYSTEM WITH REPLACEABLE CAM LOBES FOR ADJUSTING DURATION AND HYDRAULIC LIFTERS FOR RELIABILITY

(76) Inventor: Julian A. Decuir, Jr., P.O. Box 720801, Pinon Hills, CA (US) 92372

( * ) Notice: Subject to any disclaimer, the term of this patent is extended or adjusted under 35 U.S.C. 154(b) by 0 days.

(21) Appl. No.: 11/138,611

(22) Filed: May 25, 2005

(51) Int. Cl.
*F01L 1/30* (2006.01)

(52) U.S. Cl. ..... 123/90.24; 123/90.25; 123/90.26; 123/90.44; 123/90.6; 251/251

(58) Field of Classification Search ... 123/90.24–90.26
See application file for complete search history.

(56) References Cited

U.S. PATENT DOCUMENTS

| | | | | |
|---|---|---|---|---|
| 3,430,614 | A | 3/1969 | Meacham | |
| 4,920,935 | A | 5/1990 | Shida | |
| 6,311,659 | B1 | 11/2001 | Pierik | |
| 6,487,997 | B1 | 12/2002 | Palumbo | |
| 6,945,206 | B1 * | 9/2005 | Mobley | 123/90.24 |
| 6,948,468 | B1 * | 9/2005 | Decuir, Jr. | 123/90.24 |

FOREIGN PATENT DOCUMENTS

| | | |
|---|---|---|
| JP | 60081410 | 5/1985 |

* cited by examiner

*Primary Examiner*—Thomas Denion
*Assistant Examiner*—Kyle M. Riddle
(74) *Attorney, Agent, or Firm*—Stetina Brunda Garred & Brucker

(57) ABSTRACT

A desmodromic "springless" valve and adjustable cam system is provided which is adapted to be installed onto a head configured for an overhead cam for an internal combustion engine having at least one intake and one exhaust valve per cylinder. The system includes a main camshaft, a cam lobe with a follower groove formed in each side of the cam, at least one intake and one exhaust valve assigned to each cylinder, a valve connector installed onto the distal tip of each valve, a hydraulic lifter assigned to each valve. The system further includes a rocker defined by a valve movement end and lifter end, wherein the valve movement end is adapted to be mechanically linked to a respective valve connector and the lifter end is adapted to be pressed against a respective piston tip by a rocker retainer. During operation (i.e., when the main camshaft rotates), the valve movement end of the rocker moves in manner which results in each valve being moved upwards and downwards as a function of the cam duration and lift, thereby opening and closing each respective valve.

19 Claims, 9 Drawing Sheets

DESMODROMIC VALVE RETROFIT SYSTEM WITH REPLACEABLE CAM LOBES FOR ADJUSTING DURATION AND HYDRAULIC LIFTERS FOR RELIABILITY

CROSS-REFERENCE TO RELATED APPLICATIONS

The present application is related to U.S. patent application Ser. No. 10/838,107, entitled "Desmodromic Valve and Adjustable Cam System," filed on May 3, 2004 by inventor Julian A. Decuir, the content of which is expressly incorporated by reference herein in its entirety.

STATEMENT RE: FEDERALLY SPONSORED RESEARCH/DEVELOPMENT

Not Applicable

BACKGROUND OF THE INVENTION

1. Field of the Invention

The present invention relates to desmodromic valve and cam systems for internal combustion engines configured with overhead cams. In particular, the present invention relates to a cam system which eliminates the springs found in conventional valve systems by implementing a design which utilizes cam lobe assemblies with internal follower grooves in combination with a follower rocker arm and hydraulic lifters. The present invention also relates to camshafts which have replaceable cam lobes providing various duration/lift adjustability options.

2. Background of the Invention

Most conventional internal combustion piston driven engines utilize valve trains to induct an air/fuel mixture into the cylinders and to expel the burned air/fuel mixture from the cylinders. Typically, each cylinder is assigned at least one poppet intake valve and at least one exhaust poppet valve. The valves are typically pushed down by rockers thereby opening the valve. In a conventional pushrod engine, the other end of the rocker is in contact with one end of a pushrod. Further, the other end of the pushrod is typically in contact with a lifter which is in contact with a camshaft lobe. In overhead cam configurations, the other end of the rocker typically is in direct contact with the camshaft lobe, thereby eliminating the need for pushrods. To close the valve, that is to pull the valve back up so that it seats, most conventional valve trains utilize a spring which concentrically surrounds the valve stem. When the valve stem is pushed down to open the valve, the spring is compresses. The valve is closed when the spring decompresses thereby pulling the valve stem up through the valve guides until the head of the valve seats in the valve seat.

For example, in a typical four-stroke engine, an intake valve is opened by a rocker which receives an input from a cam lobe while the piston goes down inducting an air/fuel mixture into the cylinder (i.e., induction stroke). While the valve stem is being pushed down through a valve guide, a spring concentrically positioned around the valve stem is compressed. Next, when the piston moves upward, the intake valve is pushed back up through the valve guide when the spring decompresses. At this stage in the combustion process, the air/fuel mixture is compressed (i.e., compression stroke). With both valves closed so that the combustion chamber is sealed tight, a spark is then produced by a spark plug which ignites the air/fuel mixture wherein the rapidly expanding hot gases force the piston downward with great energy creating power (i.e., power stroke). The exhaust valve then opens as the piston moves back up it expels the burned air/fuel mixture (i.e., exhaust stroke).

The aforementioned conventionally configured valve train systems for opening and closing the valves has proven to be highly effective and reliable in the past. However, closing the valve by the force of the spring does have some disadvantages. Most notably, pushing the valves open against the force of the springs consumes engine power. The springs in an engine induce considerable tension into the valve train because they continuously force the valve mechanism against the rocker as the camshaft rotates. In other words, the valve springs are continuously pushing the valves closed. Another disadvantage is that because the cam mechanism cannot afford to have any "bounce" from the springs, the cam profile has to be somewhat gentle, i.e., it must gently push the valve, but never shove it. This means the valve must open slowly like a water faucet—not quickly like a light switch, for example. Another disadvantage is that when the motor is turned at high RPM's, the valves can "float" and hit the piston. Valve float happens when the speed of the engine is too great for the valve springs to handle. As a result, the valves will often stay open and/or "bounce" on their seats.

To overcome these disadvantages, innovative desmodromic valve trains have evolved over about the last century; however, in a very slow technological pace and in most applications with little or limited success. The term "desmodromic" arises from the two Greek words: "desmos" (controlled or linked), and "dromos" (course or track). A desmodromic system is also known as system that provides "positive valve actuation" wherein both strokes are "controlled". In other words, desmodromic valves are those which are positively closed by a leverage system or follower, rather than relying on the more conventional springs to close the valves. Typically, a desmodromic valve operating system utilizes a camshaft that controls both the opening and closing of the valve.

Desmodromic valve trains have several advantages over conventional spring closed valves trains. A first major advantage is that in a desmodromic valve system there is almost no wasted energy in driving the valve train. In other words, the constant force that the springs exert on the valve train is removed. Another advantage is that because there is no tension and no possibility of "bounce" in the desmodromic system, the cam profiles can be as steep as the engine designer wishes them to be. This desirable aspect allows the engine to be more powerful and more flexible. Thus, the manufacturer can use more radical cam grinds or profiles for better performance. Another advantage is that when the motor is turned at high RPM's or even over-revved, the valves are still controlled, whereas when the valves are returned by springs the valves sometimes can "float" and hit the piston.

Nevertheless, even though desmodromic valve trains have the aforementioned advantages, they have had limited success in large scale commercial applications due to reliability issues, complexity of design, and valve train binding to name a few reasons. For instance, one of the major disadvantages of desmodromic valve trains is their sensitivity to change in size of the separate component of the system. In particular, the individual components (valves, cam lobes, rockers, etc.) of the valve train become enlarged at elevated temperatures because of thermal expansion of the metallic components. Also, the components of the valve train wear, thereby, decreasing the size of the components. As a cumulative result, of both cyclic expansion and contraction of the components caused by heating, and the shortening of components caused by wear, the tolerances of the valve train can change. The end result, are components such as valves which do not seat properly, or unwanted binding in the valve train. Therefore, one of the major difficulties of prior art desmodromic valve train systems is the critical and accurate adjustment of various working components to ensure that the components operate together as intended without being subjected to binding, tension or excessive friction which results from the change of size in the individual components.

One species of desmodromic valve trains which has evolved in an attempt to solve the aforementioned problems includes desmodromic valve trains which utilize lash adjustors or hydraulic lifters to compensate for changes in size of the components of the valve train. Hydraulic lifters use the engine's oiling system to automatically adjust valve lash (clearance) to zero. Due to their dampening capabilities, hydraulic lifters help to eliminate any lash or binding problems on the system.

For instance, U.S. Pat. No. 3,430,614, entitled "Desmodromic Drive Arrangement," to MEACHAM on Mar. 4, 1969, discloses a desmodromic system which utilizes a dashpot apparatus 88 (see FIG. 8) to compensate for changing tolerances and sizes of parts in a desmodromic system. In particular, MEACHAM provides an engine valve arrangement 24 in which the valve 26, 40 is positively opened and positively closed. The mechanism for closing the valve 26, 40 comprises a rocker arm 62, 64, a movable fulcrum structure 54, 56 arranged to bias the rocker 62, 64 toward a camming mechanism 66 on order to bind the camming mechanism 66, rocker arm 62, 64 and valve 26, 40 together to effectively operate as a unit. The spring means and dashpot apparatus 88 is arranged to produce a resistance to movement away from the camming mechanism 66 that is proportional to engine speed. Although the MEACHAM system appears to viable, one of the disadvantages of MEACHAM is that it requires a unique head 10. Further, the camshaft 66 is complex and the system requires two rockers per valve.

Another reference, U.S. Pat. No. 6,487,997, entitled "Springless Poppet Valve System", issued to PALUMBO on Dec. 3, 2002, discloses a springless poppet valve system. The system includes a poppet valve 12 moveable between an open and closed position. The system includes an open cam and close cam. An open rocker arm 22 is provided which engages the open cam. The open rocker arm is operatively connected to the poppet valve so as to move the valve from the closed to open position. A close rocker arm 22 is provided which engages the close cam. The close rocker arm 22 is operatively connected to the poppet valve 12 so as to move the valve from the open position to the close position. An open hydraulic lifter 58 is pivotally connected to the open rocker arm. A close hydraulic lifter 60 is pivotally connected to the close rocker arm 22. Although the PALUMBO system successfully incorporates hydraulic lifters to increase reliability and reduce maintenance, it uses two lifters and two rockers per valve which increases the expense of the system. Furthermore, the PALUMBO system appears to require a special head design.

Also, Japanese Patent No. JP60081410, entitled "Compulsorily Valve Opening and Closing Apparatus for Internal-Combustion Engine," issued to JIYUNJI et al. on May 9, 1985, discloses a system a motorcycle head and valve train which utilizes an "automatic hydraulic slit adjusting apparatus" to compensate for changing tolerances and sizes of parts in desmodromic systems. In particular, JIYUNJI discloses a rocker arm 49 for compulsorily opening a valve and a rocker arm 50 for closing the valve, which are installed in swingable ways onto an eccentric shaft 54 supported onto a rocker-arm shaft, and driven by a valve opening cam 46 or a valve closing cam 47. The eccentric shaft 54 has an arm 71 which contacts an automatic hydraulic slit adjusting apparatus 51, and the eccentric shaft 54 is turned by the extension and contraction of the automatic slit adjusting apparatus, and the slit can be automatically adjusted by shifting each swingable-shaft core of the rocker arms 49 and 50 in the direction of each axis center of the valves 32 and 33. Although, it appears JIYUNJI provides a desmodromic system with enhanced reliability by incorporating a hydraulic slit adjusting device, the JIYUNJI system is configured only for motorcycle engines and is not easily adapted to conventional engines for automobiles.

Another prior art reference, U.S. Pat. No. 6,311,659, entitled "Desmodromic Cam Driven Variable Valve Timing Mechanism," issued to PIERIK, on Nov. 6, 2001, discloses a system which utilizes stationary hydraulic lash adjusters 56 to compensate for changing tolerances and sizes of parts in desmodromic systems. In particular, PIERIK discloses a desmodromic cam driven variable valve timing (VVT) mechanism 10 which includes dual rotary opening and closing cams 18, 20 for actuating a rocker mechanism 34 that drives valve actuating oscillating cams. The dual rotary cam drive positively actuates the rocker mechanism 34 in both valve opening and valve closing directions, and thus, avoids the need to provide return springs to bias the mechanisms toward a closed valve position. It is noted that although the PIERIK invention is claimed to be "desmodromic", it still utilizes valve springs (not shown; see col 3, lines 7–9), which are conventionally provided for biasing the valves in a closing direction. Therefore, even though the system is claimed to be "desmodromic" it appears that the inclusion of the valve springs still induce a binding tension to the valve train, which as an end result reduces the engine's power and efficiency. Furthermore, the VVT mechanism in the PIERIK invention is a complex system requiring numerous parts which does not yet have a proven track record with regard to reliability. Additionally, the PIERIK invention appears to require a unique head design which increases the expense of the overall system installation.

By utilizing lash adjustors or hydraulic lifters some of the disadvantages that have long been associated with desmodromic valve trains have been alleviated as taught by MEACHAM, PALUMBO, JIYUNJI and PIERIK. However, although MEACHAM, PALUMBO, JIYUNJI and PIERIK teach functional desmodromic systems, they still have similar disadvantages. One of the problems with the aforementioned desmodromic valve train systems is that they have not been adapted to be installed or "retrofit" into existing modern conventional engines. That is to say, the aforementioned prior art desmodromic systems appear to utilize specialized head designs which requires a unique head. Thus, to use the aforementioned desmodromic systems, the entire head and valve train must be replaced.

Therefore, it would be advantageous to provide a desmodromic valve and cam system which utilizes hydraulic lifters or the like that may be either integrated into a new engine design or of which may be retrofit onto an existing engine head design without requiring the head or valves to be replaced. Such a springless system would operate more efficiently than conventional valvetrains since the tension is reduced from the valvetrain resulting in greater horsepower and fuel economy; while the incorporation of hydraulic lifters or the like will make the desmodromic system more reliable. By providing a retrofit desmodromic system, the cost of the upgrade could be maintained lower than that of a system which requires the entire head to be replaced. It would further be advantageous to provide a desmodromic valve and cam system which is simple to manufacture, inexpensive and of which may be easily retrofitted into existing head designs which may have already been manufactured and of which are being currently sold. Furthermore, it would be desirable to provide a desmodromic valve and cam system which would have interchangeable cam lobes such that the cam duration/lift could be adjusted. With such a feature, various cam lobes having varying profiles, durations, lift, etc. could be utilized on the same system by merely replacing the cam lobes. Such features would provide a wide array of adjustability in regards to being able to tune the engine's performance characteristics.

BRIEF SUMMARY OF THE INVENTION

In general, the present invention provides a desmodromic valve and cam system which utilizes hydraulic lifters or the like that may be integrated into an engine design or of which may be retrofit onto an existing engine head design without requiring the head or valves to be replaced. The present invention operates more efficiently than conventional valvetrains since binding tension is reduced from the valvetrain resulting in greater horsepower, better fuel economy and reduced emissions; while the incorporation of hydraulic lifters or the like makes the present invention desmodromic system more reliable. By providing a retrofit desmodromic system, the cost of installing the present invention into a vehicle is significantly reduced since the entire head does not have to be replaced. Furthermore, the present invention desmodromic valve and cam system is simple to manufacture and may be retrofitted onto conventional engines which have already been manufactured which are being currently sold. Furthermore, the present invention desmodromic valve and cam system has interchangeable cam lobes. With this feature, various cam lobes having varying profiles, durations, lift, etc. may be utilized on the same system, thereby, providing a wide array of adjustability in regards to being able to tune the engine's performance characteristics.

According to an aspect of the present invention, a desmodromic "springless" valve and adjustable cam system is provided which is adapted to be installed onto a head configured for an overhead cam for an internal combustion engine having at least one intake and one exhaust valve per cylinder. The system includes a main camshaft adapted to be positioned within a plurality of bearing journals transversely positioned and spaced along a longitudinal length of the head; a cam lobe assigned to each valve, each cam lobe adapted to be installed onto the main camshaft, each cam lobe defined by first and second opposing sides, a perimeter edge, a mounting hole disposed through the first and second sides in a normal orientation, and a follower groove formed in each side of the cam which is representative of a desired cam duration; at least one intake and at least one exhaust valve assigned to each cylinder, each valve adapted to be received within a respective valve guide disposed within the head, each valve having a valve stem with a distal connecting tip exposed above the head; a valve connector installed onto the distal tip of the valve; a hydraulic lifter assigned to each valve which is adapted to be received within a lifter seat disposed within the head, each lifter including a moveable piston within, the piston having piston tip which is exposed above the head; a rocker defined by a valve movement end and lifter end, the valve movement end adapted to be mechanically linked to a respective valve connector and the lifter end adapted to be pressed against a respective piston tip; and a rocker retainer adapted to maintain the lifter end of the rocker depressed against the piston tip of the hydraulic lifter. During operation (i.e., when the main camshaft rotates), the valve movement end of the rocker moves in a manner which results in each valve being moved upwards and downwards as a function of the cam duration and lift, thereby opening and closing each respective valve.

According to another aspect of the present invention, the hydraulic lifters automatically adjust valve lash for each valve. According to another aspect of the present invention, each rocker may include a first and second rocker half adapted to be sandwiched together such that a portion of a respective cam lobe may be movably received between both halves, and a connecting pin rigidly attached to each rocker half in a normal orientation such that each pin is received within the following grooves formed in each side of the respective cam.

And yet in another aspect of the present, a valve keeper fitting is provided which has a bore disposed there through for receiving the valve stem, the keeper fitting further including an upper portion having a frustro-conical shaped seat formed therein and conventional male threads formed external thereto; and a lower portion having a flange adapted to be received by a tool; and a pair of frustro-conically shaped valve keepers. Each valve may have at least one radial groove formed on the valve stem for receiving the pair valve keepers, wherein the keeper fitting is adapted to be installed into a lower end of the valve connector such that the pair of valve keepers are received into the frustro-conical shaped seat and maintained by a compression fit. The desmodromic valve and adjustable cam system may further include a coil spring positioned between the distal tip of the valve stem and the valve connector for dampening shock imparted to the valve.

Another aspect of the present invention includes the hydraulic lifter further comprising a generally cylindrically-shaped lifter body having a first cylindrical cavity disposed therein which is adapted to receive the moveable piston; a coil spring concentrically retained internally within the piston such that it is biased between a spring retainer within the piston and a lower backing surface of the lifter body; and an oil passage disposed through the lifter body for directing oil into the hydraulic lifter. Oil is fed into the lifter from an oil supply line disposed within the cylinder head, wherein the lifter acts as a dampener that maintains a constant, yet adjustable tension, to the rocker.

Moreover, another aspect of the present invention may include the valve connector comprising a valve connecting fitting defining a cap having female threads internally formed therein which are adapted to receive the upper portion of the valve keeper fitting, the fitting having formed internally therein a valve tip seat which is adapted to receive the distal tip of the valve stem; and a rocker connecting end which includes a receiving slot which is adapted to slidably and rotatably receive the connecting pin from the follower rocker.

According to yet another aspect of the present invention, a cam gear may be attached to a first end of the main camshaft, wherein the cam gear is adapted to be via a chain which is driven from a crankshaft of the engine. The desmodromic valve and adjustable cam system may further include a cam gear hub which interconnects the cam gear to the main camshaft. With such an arrangement, the timing of the engine may be either advanced or retarded by radially clocking the cam gear with respect to the cam hub.

According to another aspect of the present invention, the system may further include a pair of end journal bearing hubs attached to the main camshaft, the pair including a first journal hub positioned proximate the cam gear, and a second journal hub positioned proximate a second end of the main camshaft, wherein the journal bearing hubs are adapted to be received by end journals of the head.

According to other aspects of the present invention, the mounting hole of each cam lobe may have a cam lobe key receiving slot formed along a length of the mounting hole; and the main camshaft may have a camshaft key receiving slot disposed in an exterior surface of the shaft for each respective cam lobe; wherein a key may be installed into the cam lobe key receiving slot for each cam lobe and a respective camshaft key receiving slot assigned to each respective cam lobe for rigidly securing the cams lobes to the main camshaft.

According to another aspect of the present invention, the system may further include a plurality of cam lobe assembly kits adapted to be installed and removed onto the main camshaft, wherein each kit provides a differing cam profile offering a unique set of tuning characteristics for each respective kit. While in another aspect of the present invention, the main camshaft is adapted to be retained within the plurality of bearing journals by utilizing conventional journal caps.

According to another aspect of the present invention, the rocker retainer includes a rocker roller retainer bracket having a distal arm with a roller transversely integrated into the distal arm, wherein the roller is positioned such that it is maintained in contact with an upper surface of the lifter end of the rocker. For instance, in one embodiment, the rocker roller retainer bracket is adapted to be mounted to the upper surface of the head. In another embodiment, the rocker roller retainer bracket is adapted to be mounted directly over conventional journal caps utilized to retain the main camshaft within the plurality of bearing journals.

Other exemplary embodiments and advantages of the present invention may be ascertained by reviewing the present disclosure and the accompanying drawings.

BRIEF DESCRIPTION OF THE DRAWINGS

The present invention is further described in the detailed description that follows, by reference to the noted drawings by way of non-limiting examples of preferred embodiments of the present invention, in which like reference numerals represent similar parts throughout several views of the drawings, and in which:

FIG. 3 shows a detailed cross-sectional view of the valve and valve connector assembly from FIGS. 1 and 2, which includes the valve, a pair of valve keepers, the valve keeper fitting, an internal valve stem dampening spring, and the valve connector, according to an aspect of the present invention; while FIG. 3A shows detailed cross-sectional view of an alternative embodiment of another valve connector assembly, which includes linking member, a pair of threaded locking retainers, a pair of valve keepers, and a pair of wave washers.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention provides a desmodromic valve and adjustable cam system for an overhead cam configured combustion engine which may be retrofit onto an existing engine design or which may be integrally included into a new engine design. The present invention eliminates the use of valve springs normally used to close poppet valves. In general, the desmodromic valve and adjustable cam system is positioned and installed in the top of the head 4. The present invention is designed such that it may be incorporated into modern engine designs yet to be manufactured, or it may be retrofit to existing head designs, such as used in conventional overhead cam V8's, V6's, V10's, in-line 4's, inline 6's or the like. The desmodromic valve and adjustable cam system may be utilized with gasoline type engines or diesel engines.

It is noted that the conventional head 4 depicted in throughout the Figures is merely one example of a conventional head used on internal combustion engines with overhead cams. It is further appreciated that the present invention may be installed and/or retrofitted to fit on many other conventional overhead cam heads 4 that have been previously manufactured or of which are currently being manufactured from numerous engine manufacturers. Additionally, it is recognized that the present invention may be integrated into specially designed heads. Thus, the scope of the invention should not be limited to the exemplary embodiment disclosed in the instant specification. Rather the exemplary embodiment of the desmodromic cam and valve system should be viewed as merely one embodiment of numerous embodiments which may utilize the fundamental concepts taught and disclosed in the instant application.

Figure 1:
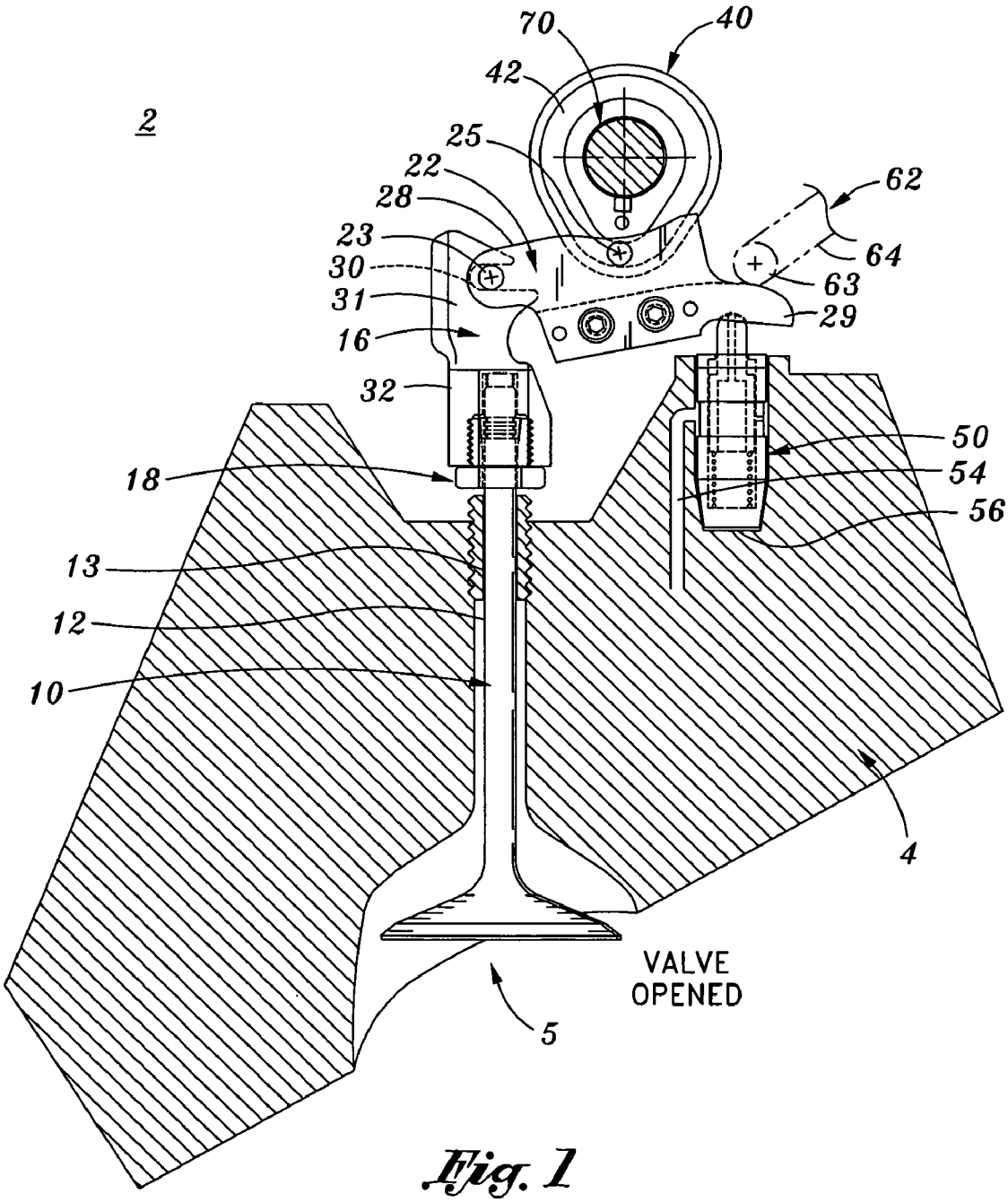
FIG. 1 shows a sideview and partial cross-section of the present invention's valve, valve connector, follower rocker, cam lobe with following grooves, hydraulic lifter, and lifter retainer wherein the valve is positioned open, according to an aspect of the present invention.
Figure 2:
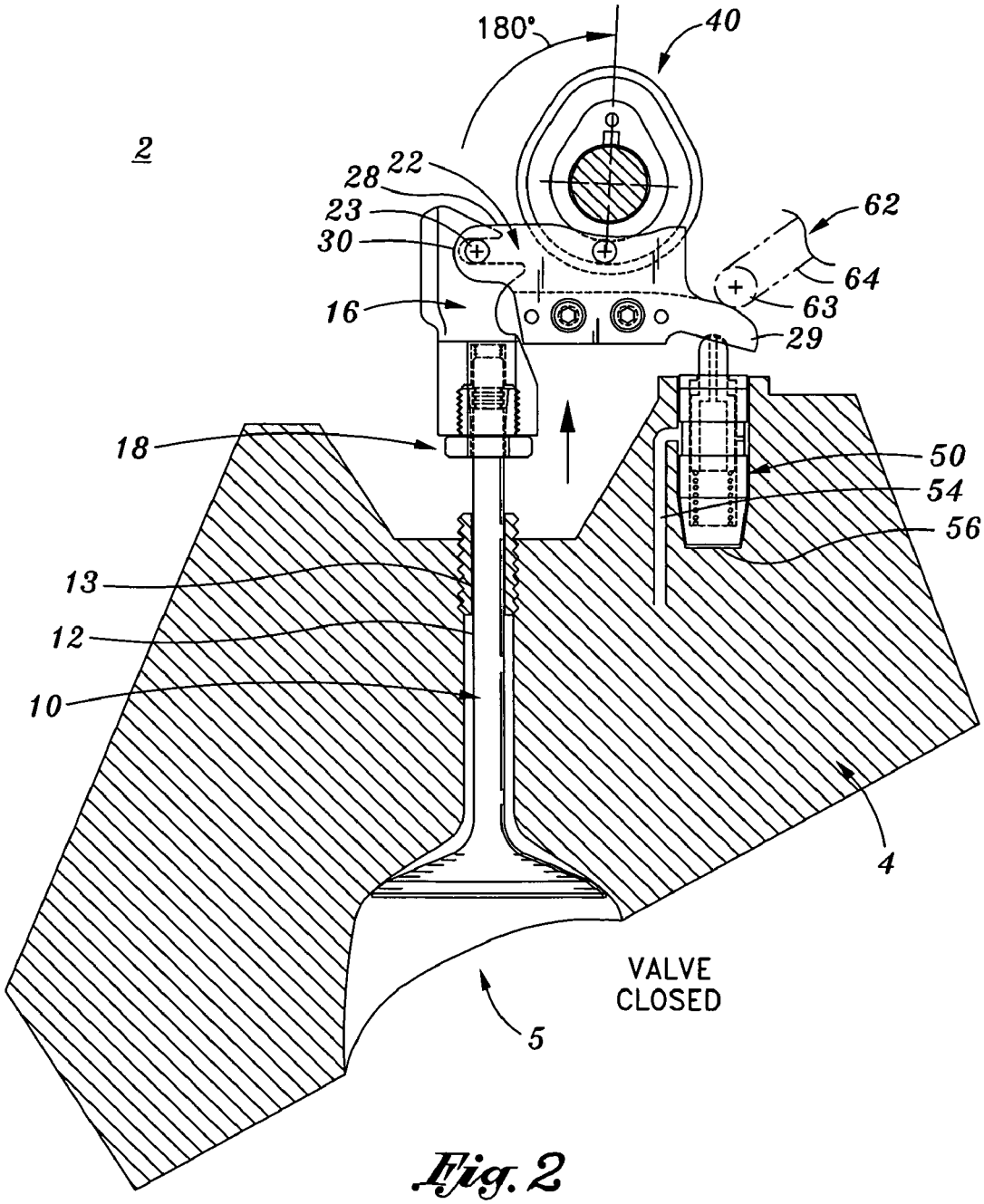
FIG. 2 shows a sideview and partial cross-section of the present invention's valve, valve connector, follower rocker, cam lobe with following grooves, hydraulic lifter, and lifter retainer when the valve is positioned closed, according to an aspect of the present invention.

One aspect of the present invention is that it is particularly suited well for single overhead cam systems. As shown in FIGS. 1–2, the main camshaft 70 is positioned above the head 4 resulting in a single overhead cam configuration. Thus, for a V-configured engine, such as a V-8, V-6, V-10 or the like, a main camshaft 70 is used for each cylinder bank of the internal combustion engine. Hence, for example, with an in-line four cylinder engine, one camshaft 70 may be utilized. For, a conventional V-8 engine, a camshaft 70 is utilized over each head 4. Thus, the present invention may be considered an overhead cam design in the most generic sense. However, it is further recognized that the present invention may also be utilized in dual overhead cam configurations.

FIG. 1 shows a side view and partial cross-section of an exemplary embodiment of the present invention desmodromic valve and cam system 2 which has been adapted to retrofitted/or installed into an engine which includes single overhead cams with two valves per cylinder (intake/exhaust). In particular, FIG. 1 shows a side view and partial cross-section of the cylinder head 4 which is configured with a single overhead cam (per cylinder bank) and two valves per cylinder (intake/exhaust). The desmodromic system 2 includes a conventional valve 10, valve connector 16, follower rocker 22, cam lobe 40 (with following grooves 42) mounted to main cam shaft 70, hydraulic lifter 50, and lifter retainer 62 when the valve 10 is positioned open, according to an aspect of the present invention. The valve 10 is removably attached to the valve connector 16 via a valve keeper fitting 18. A follower rocker 22 interconnects the valve connector 16 with the cam lobe 40 and the hydraulic lifter 22 through at several connecting points. The first connection point includes a valve stem connector pin 23 which is slidably received by the valve connector 16.

FIG. 2 shows a sideview and partial cross-section of the desmodromic system 2 when the valve 10 is positioned closed, according to an aspect of the present invention. As can be seen from FIG. 2, after the main cam shaft 70 rotates 180 degrees, the valve 10 is in the fully closed or "seated". The main cam shaft 70 is driven by a cam gear 74 (not shown) which is driven from the engine's crankshaft (not shown) via a belt drive system (not shown). The rotation imparted to the cam shaft 70 also rotates the cam lobes 40 in a direct one to one ratio. The follower rocker 22 has at least one cam following groove pin 25, 27 which is received within a following groove 42 disposed within at least one side surface of the cam lobe 40. When the cam lobe 40 rotates, the follower rocker 22 translates the rotational input into an upward and downward linear displacement movement exhibited valve movement end 28 of the follower rocker 22. In particular, a valve connecting pin 23 is transversely positioned across the valve movement end 28 such that it may be slidably and rotationally connected to a receiving slot 30 formed in the rocker connecting end 31 of the valve connector 16. As a result, the valve connector 16, which is directly attached to the upper end of the valve 10 via the valve fitting 32 and valve keeper fitting 18, moves the valve 10 in an upward and downward motion along an axis defined by the center axis of the valve 10. Thus, each time the main cam shaft 70 rotates 180 degrees, the valve 10 goes from an open position to a closed position or vice-versa (closed position to an open position).

Still referring to FIGS. 1 and 2, the hydraulic lifter connecting end 29 of the follower rocker 22 (which is opposite the valve movement end 28) is continuously biased against the hydraulic lifter 50. It is noted that in the exemplary embodiment shown in the Figures, that the hydraulic lifter 50 is the stock lifter found in a conventional single overhead cam engine. The hydraulic lifter 50 is also positioned within or received within the stock lifter receiving seat 56 which is generally cylindrical in shape. In general, the hydraulic lifter 50 is provided to absorb changes dimension/tolerances in the valve train due to heat and to further provide a dampener to the valve train. The details of the hydraulic lifter are discussed later in the specification.

Figure 3:
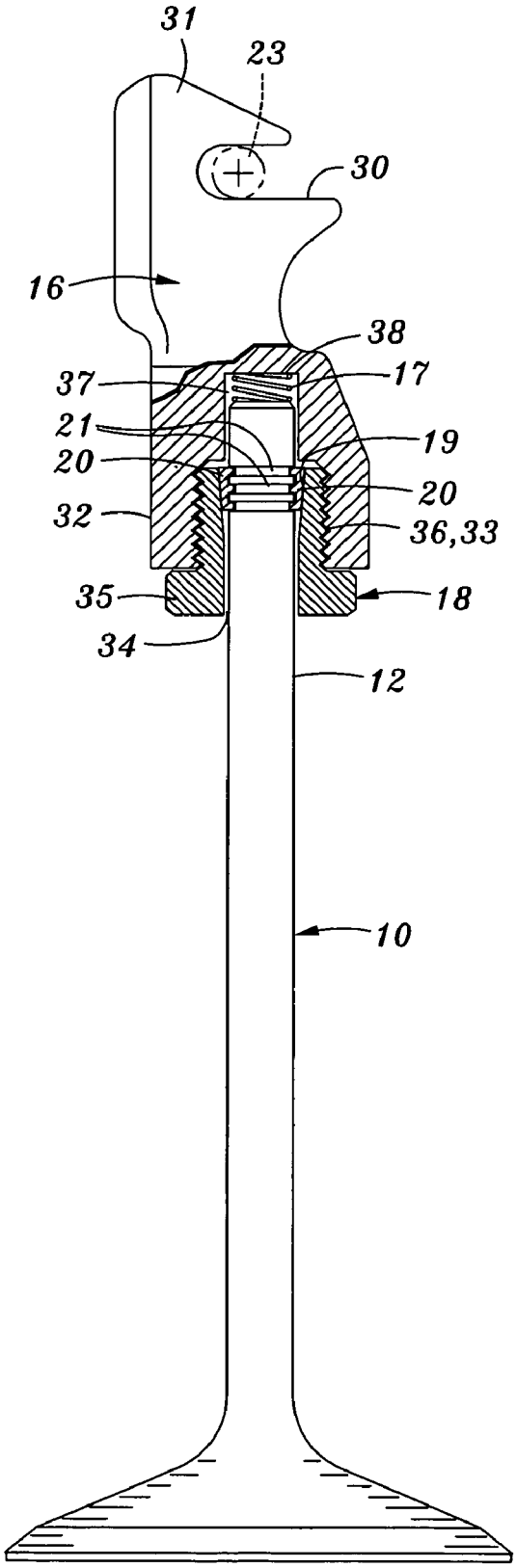

FIG. 3 shows a detailed cross-sectional view of the valve and valve connector assembly, which includes the valve stem 12, a pair of valve keepers 20, the valve keeper fitting 18, an internal valve stem dampening spring 17, and the valve connector 16, according to an aspect of the present invention. It is first noted that the present invention is adapted to be able to utilize the stock valves 10 and valve keepers 20 from the engine intended to be retrofit with the present invention. For instance, the engine utilizes valves 10 which have a plurality radial grooves 21 disposed on the upper portion of the stems 12 which are adapted to receive a pair of conventional or stock valve keepers 20. The valve keeper fitting 18 is first slid over the valve stem 12 beyond the plurality of radial grooves 21. Next the pair of valve keepers 20 are installed into the plurality of grooves 21 in a clamshell manner. In particular, the valve keepers 20 are clam-shelled around the valve stem 12 such that they form a frustro-conical shape which is adapted to be received into a frustro-conical shaped seat 19 formed within the valve keeper fitting 18. The valve keeper fitting 18 is a generally cylindrical shaped fitting having bore 34 disposed through the center axis of the fitting such that the valve stem 12 may be received through the bore 34. As discussed above, the upper portion of the fitting 18 includes a frustro-conical shaped seat 19 formed therein which is adapted to receive the valve keepers 20 in a compression fit. Externally formed thereon the upper portion of the fitting 18 are conventional male threads 31 which are adapted to be received by valve connecting fitting 32 which forms the lower portion of the valve connector 16. The lower portion of the fitting 18 includes a bolt head shaped or square shaped portion which is adapted to be tightened by a wrench.

Still referring to FIG. 3, the present invention utilizes a valve connector 16 to interconnect the valve connecting fitting 32 and the valve movement end 28 of the follower rocker 22, in particular the valve connector pin 23. The valve connector 16 comprises two main portions, including a valve connecting fitting 32 and a rocker connecting end 31. Preferably the valve connecting fitting 32 has a hexagonal cross-section, similar to that of conventional fluid fittings, such that the valve connection fitting 32 may be engaged by a tool, such as a box wrench. The valve connection fitting 32 internally defines a cap having female threads 36 internally formed therein which are adapted to receive the upper portion of the valve keeper fitting 18. Furthermore, internally formed within the valve connecting fitting is a valve tip seat 37 which is adapted to receive the distal tip 15 of the valve stem 12. It is additionally noted that an optional coil spring 17 may be disposed between the distal tip 15 of the valve stem 12 and the valve connecting fitting 32 wherein the coil spring acts as a dampener between the distal tip 15 of the valve stem 12 and the valve connecting fitting 32 the backing surface 38 of the valve tip seat 37. Integrally formed thereto the upper portion of the valve connection fitting 32 of the valve connector 16 is rocker connector end 31 which includes a receiving slot 30 which is adapted to slidably and rotatably receive the valve connecting pin 23 from the follower rocker.

FIG. 3A shows a detailed cross-sectional view of an alternative embodiment of the valve connector assembly 98, according to an aspect of the present invention. In this embodiment, a main valve connector body 99 is provided with an internal cavity 106 which is adapted to receive the upper portion of the valve stem 12 and further house numerous parts including a pair of threaded locking retainers 102, a pair of wave washers 103, 104 and a pair of conventional valve keepers 20 (similar to those of the first embodiment). In particular, the internal cavity 106 has a lower cylindrical portion adapted to receive at least one first wave washer 104, the valve keepers 20 and at least one second wave washer 103. To retain the aforementioned assembly inside the internal cavity 106, including the distal end of the valve stem 12, an upper portion of the internal cavity 106 is provided with threads for receiving a pair of threaded locking retainers 102. The locking retainers 102 may include passages 105 which are adapted to receive a tool for installation purposes. By installing the pair of threaded locking retainers 102, not only are the pair of wave washers 103, 104, pair of conventional valve keepers 20, and the upper valve stem 12 retained within the internal cavity 106, but also by selection of wave washers 103, 104 having various combinations of spring resistances, preloads may be applied and/or adjustments to of the position of the valve 10 with respect to the main body 99 may be implemented (which translates to adjusting the lash). Thus, this feature provides adjustability with regard to how the head of the valve 10 seats in the valve seat. Moreover, the aforementioned wave washers 103, 104 help prevent damage to the head of the valve 10 if the valve head is hitting the valve seat when the valve 10 is in its closed position. Thus, one of the benefits of the alternative valve connector assembly 98 is that the valve position and/or lash may be adjusted to prevent the valve head from being pulled excessively against the valve seat, but while at the same time providing a shock absorbent feature to ensure the valve head is being sufficiently pulled upwards to the valve seat for proper closing and sealing of the combustion chamber. It is further noted that that formed thereon the upper end of the main valve connector body 99 are a pair of yoke arms 108 (only one of two shown in FIG. 3A) which are adapted to rotatably receive a second connecting pin 101 through a receiving hole 110 disposed through each yoke arm 108. Furthermore, as shown in FIG. 3A, a linking member 100 is provided which includes a pair of pin receiving holes 112 for rotatably receiving the second connecting pin 101 and the valve connecting pin 23 from the follower rocker 22. As a result, a linkage system is provided which receives input from the follower rocker 22 and of which translates motion from the follower rocker 22 to upward and downward valve 10 movement.

Figure 4:
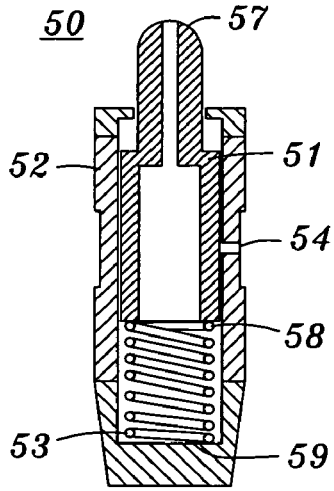
FIG. 4 shows a detailed cross-sectional view of the hydraulic lifter and associated cylindrical seat formed in the cylinder head from FIGS. 1 and 2, according to an aspect of the present invention.

FIG. 4 shows a detailed cross-sectional view of the hydraulic lifter 50 and associated cylindrical lifter seat 56 formed in the cylinder head 4 from FIGS. 1 and 2, according to an aspect of the present invention. In some applications, the hydraulic lifter 50 may be a stock part engine part. It is further contemplated that other overhead cam cylinder heads which may not utilize the hydraulic lifter may be adapted or modified to incorporated the hydraulic lifter 50. As shown in FIG. 4, the lifter 50 includes a cylindrically shaped lifter body 52 having a cylindrically cavity disposed therein which is adapted to receive a movable piston 51. A connecting tip 57 having a rounded end is formed on the top of the piston 51 which is adapted to be in constant contact with the hydraulic lifter connecting end 29. The moveable piston 51 is further hollowed out within such that a spring 53 may be concentrically retained internally within the piston 51 and the lower end of the lifter body 51. The lifter body 51 further includes an oil passage 55 which is supplied with oil from an oil supply line 54 disposed within the cylinder head 4. In operation, oil is filled within the piston 51 such that the lifter 50 acts as a dampener that maintains a constant, yet adjustable tension, on the follower rocker 22. Furthermore, since hydraulic lifters 50 are used in the desmodromic cam and valve system 2, the valves 10 in the present invention do not need to be adjusted.

Figure 5:
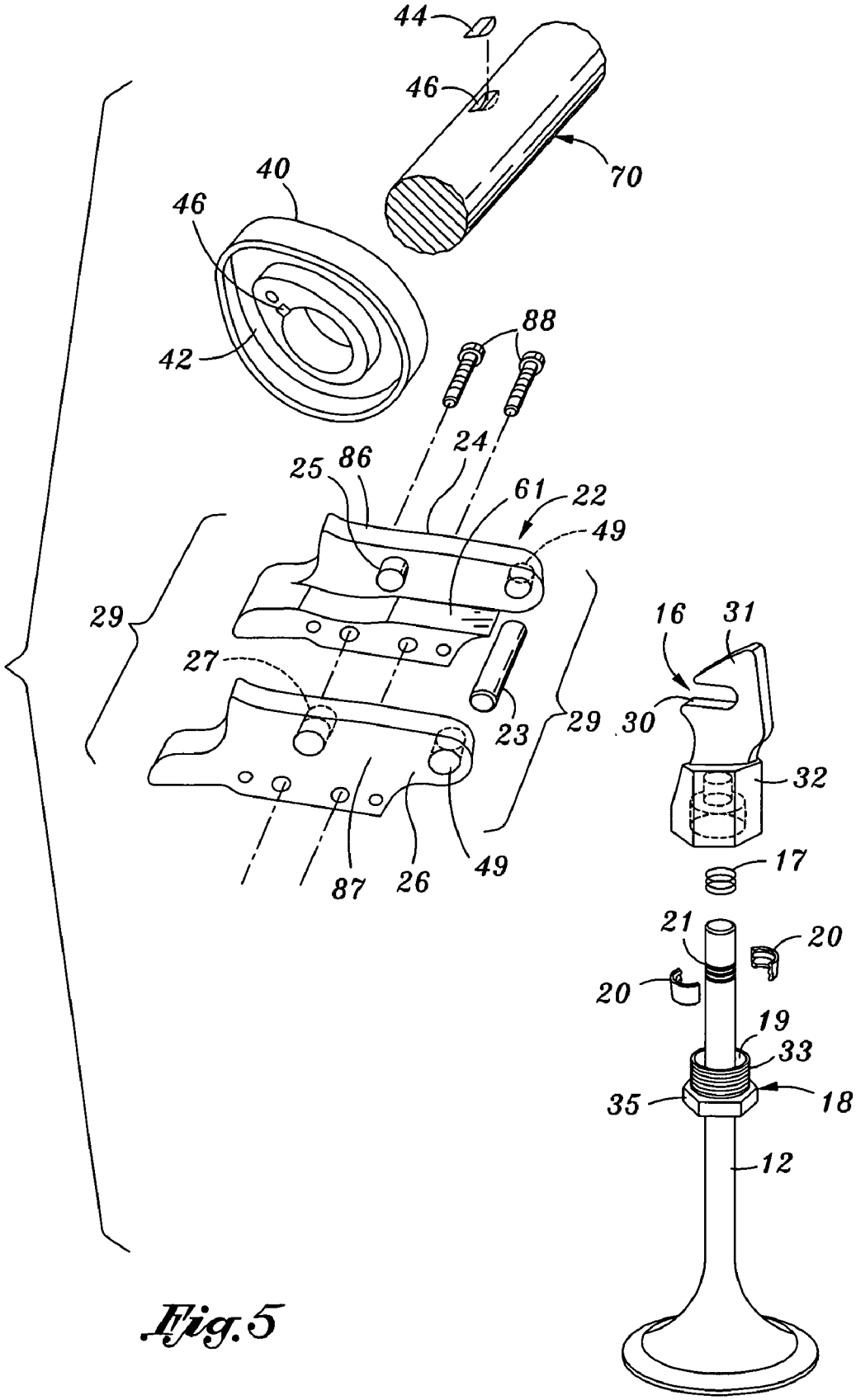
FIG. 5 shows an exploded view of the components from FIGS. 1 and 2, which includes the main camshaft, cam lobe with following grooves disposed thereon, follower rocker, valve connector, valve keeper fitting and valve stem valve, according to an aspect of the present invention.

FIG. 5 shows an exploded view of the components from FIGS. 1 and 2, which include the main camshaft 70, cam lobe 40 with following grooves 42 disposed thereon, follower rocker 22, valve connector 16, valve keeper fitting 18 and valve 10, according to an aspect of the present invention. In particular, FIG. 5 shows an exploded perspective view of follower rocker 22 which comprises the first rocker member half 24 and second member half 26. Each rocker half 24, 26 includes a rocker sidewall 86, 87 which are arranged in an opposing orientation such that when the rocker halves 24, 26 are assembled together, a slot is formed there between which receives the cam lobe 40. Further it is noted from FIG. 5, that each rocker sidewall 86, 87 includes a following groove pin 25, 27 which is adapted to be received into the cam lobe following grooves 42 which are formed in each side of the cam lobe 40. FIG. 5 further shows the valve movement end 28 of the rocker 22 wherein each rocker halve 24, 26 has a pin receiving hole 49 for receiving the valve connecting pin 23. Further shown in the exploded perspective of the rocker 22 is a rocker spacing portion 61 of the rocker 22 which may be integrally formed on at least one of the rocker halves 24, 26 in order to space the first and second rocker halves 24, 26 apart. It is further noted that the rocker halves 24, 26 are attached together with conventional fastening hardware such as machine hex head screws 88.

Cam Assembly

Figure 6:
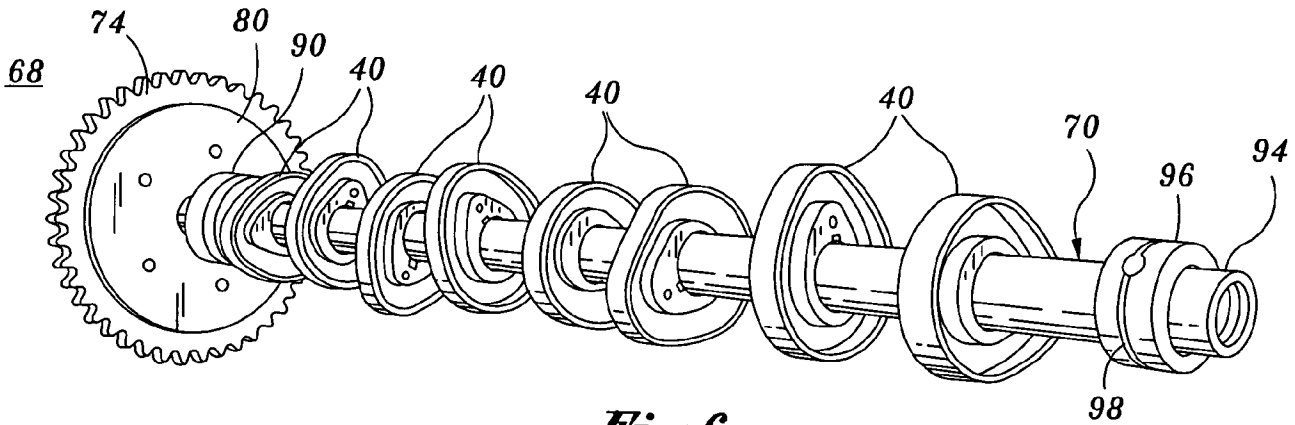
FIG. 6 shows a perspective view of the entire camshaft assembly which includes the main camshaft with the cam lobes installed thereon, cam gear, cam gear hub, connecting hub and end collar, according to an aspect of the present invention.

FIG. 6 shows a perspective view of the entire camshaft assembly 68 which includes the main camshaft 70 with a plurality cam lobes 40 installed thereon, cam gear 74, cam gear hub 80, connecting hub 90 and end collar 96, according to an aspect of the present invention. For the exemplary camshaft assembly used on each cylinder head 4, eight cam lobes 40 [two per cylinder (intake/exhaust)] are attached to the main camshaft 70. Each cam lobe 40 is attached to the main cam shaft 70 by a woodruff key 44 which is inserted into a first key receiving slot 46 formed in the perimeter surface of the camshaft mounting holes 41. Additionally, a plurality second key receiving slots 72 are formed in the outer surface of the main shaft in a longitudinal orientation with respect to the axis of the shaft 70.

Figure 7:
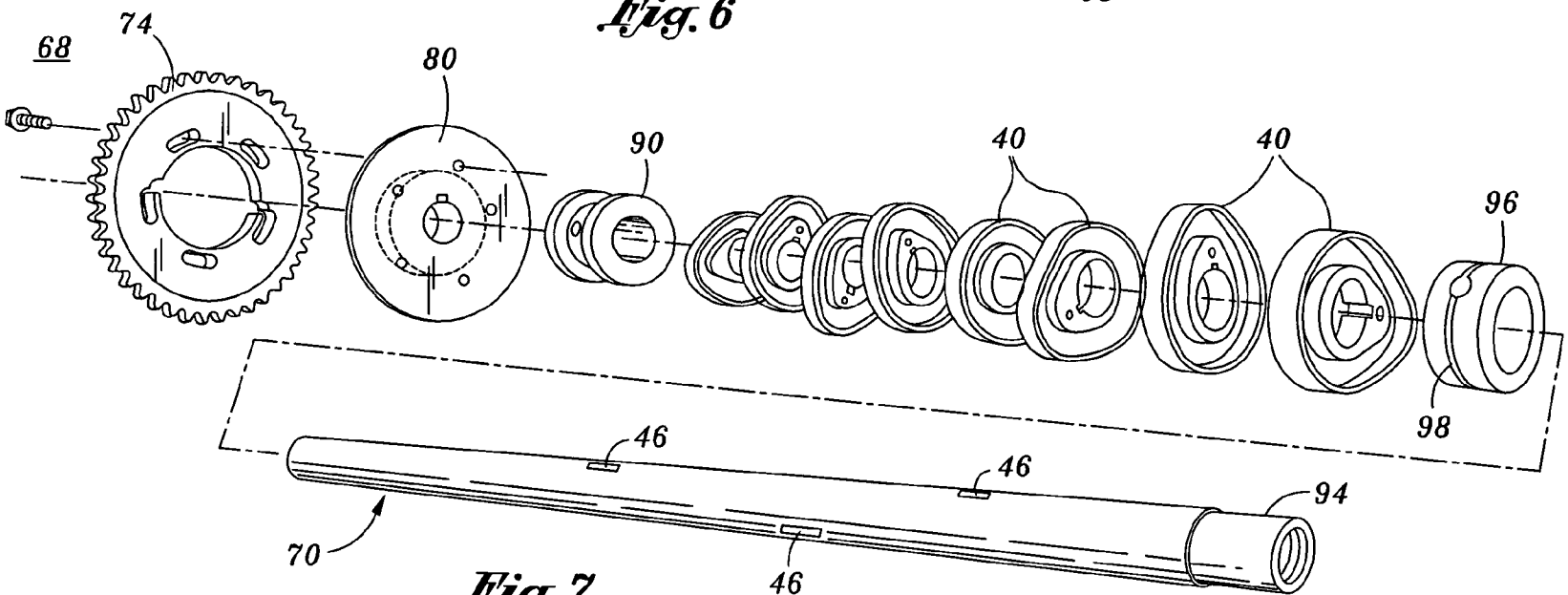
FIG. 7 shows an exploded view of the camshaft assembly from FIG. 6 which includes a separate main camshaft, numerous cam lobes, a cam gear, a cam gear hub, a connecting hub and an end collar, according to an aspect of the present invention.

FIG. 7 shows an exploded view of the camshaft assembly from FIG. 6 which includes the main camshaft 70 with a plurality cam lobes 40, cam gear 74, cam gear hub 80, connecting hub 90 and end collar 96 disassembled therefrom, according to an aspect of the present invention. The main camshaft 70 is generally a longitudinal rod with, as discussed above, a plurality second key receiving slots 72 are formed in the outer surface of the main shaft in a longitudinal orientation with respect to the axis of the shaft 70. It is noted that the key receiving slots 72 are formed in varying radial positions about the circumference of the camshaft 70 and further spaced at desired intervals along to longitudinal length of the camshaft 70.

Figure 8:
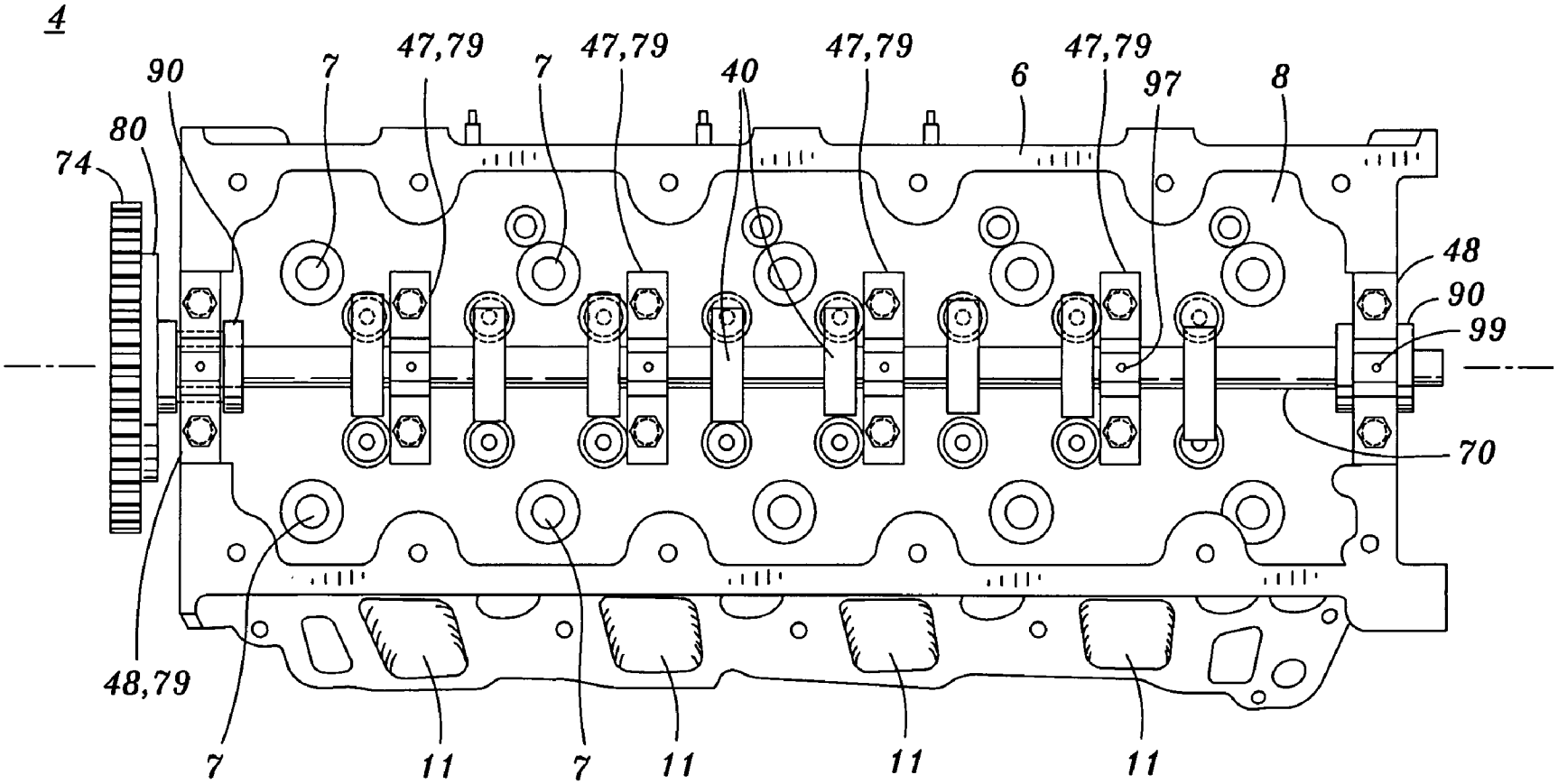
FIG. 8 shows a top view of a conventional stock single overhead cam head with the exemplary cam assembly from FIG. 6 installed into the cam journals thereof, according to an aspect of the present invention.

FIG. 8 shows a top view of a conventional stock single overhead cam head 4 with the exemplary cam assembly 68 from FIG. 6 installed into the cam journals 47, 48 thereof, according to an aspect of the present invention. The top of the head 8 has a valve cover interface 6 which defines an upright perimeter wall structure around the entire head 4. The head 4 has a plurality of exhaust ports 9 (not shown in FIG. 8) and intake ports 11. The top of the head 8 typically has a plurality of head bolt mounting holes 7 which are used to secure the bottom of the head to the top deck of the engine block (not shown). The head 4 is disposed with a plurality of valve guides 13 (see FIGS. 1 and 2) which provide a passage for the valve stems 112 (not shown in FIG. 8, see FIGS. 1 and 2). As can be seen from FIG. 8, the end journal bearing hubs 90 which are positioned on both ends of the assembly 68, adapted to be received into the main cam journals 48 positioned at both ends of the head 4. Further, the main camshaft 70 is also adapted to be directly received by the internal cam journals 47. Once the cam assembly 68 is positioned within the journals 47, 48, the stock or conventional journal caps 79 are installed to secure the cam assembly 68 into the head 4.

Rocker Roller Retainer Bracket Embodiments

Figure 9:
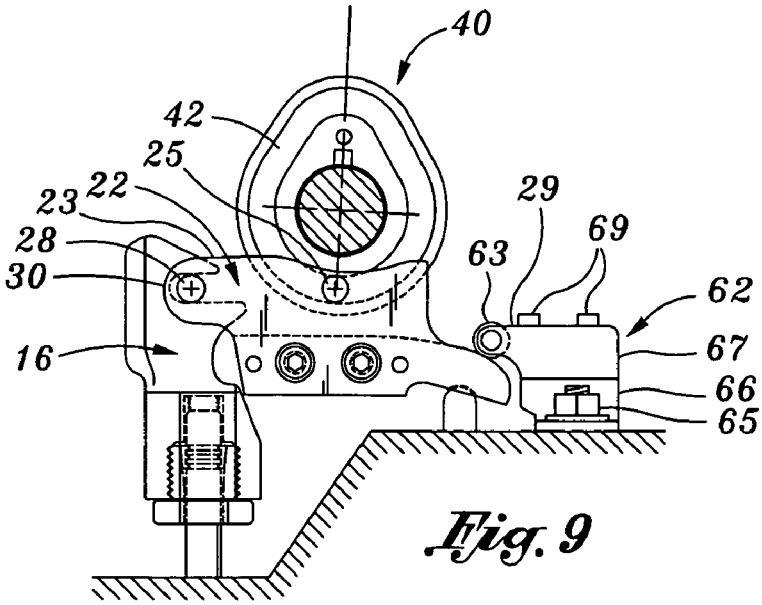
FIG. 9 shows a detailed cross-sectional view of a first embodiment of the rocker roller retainer bracket, wherein the roller retainer is positioned such that it is in contact with an upper surface of the lifter end of the rocker depressed against the piston tip of the hydraulic lifter, according to an aspect of the present invention.

FIG. 9 shows a detailed cross-sectional view of a first embodiment of the rocker roller retainer bracket 62. The bracket 62 is positioned such that it is in contact with an upper surface of the lifter end 29 of the rocker 22 depressed against the piston tip 57 of the hydraulic lifter 50, according to an aspect of the present invention. The first embodiment of the rocker roller retaining device 62 is adapted to be bolted directly to the top 39 of the head 4 using the stock head bolts 65. As is shown in FIG. 9, the first embodiment of the retainer bracket 62 may comprise two parts including a lower head mounting base 66 and an upper retainer bracket 67 which may be attached to the mounting base 66 via standard fastening hardware such as set screw bolts 69. A distal arm 64 is formed on the upper retainer bracket 67 such that a roller 63 may be rotatably integrated therein. The rocker roller retainer bracket 62 is installed onto the head 4 such that the roller 63 is positioned over the lifter connecting end 29 of the follower rocker 22 in a non-moveable rigid manner. Thus, in operation, when the follower rocker 22 moves up and down as a function of the valve movement, the upper arcuate surface of the lifter connecting end 29 is adapted to be in contact with the roller 63 while still having the ability to roll across the roller 63 to accommodate the movement of the follower rocker 22.

Figure 10:
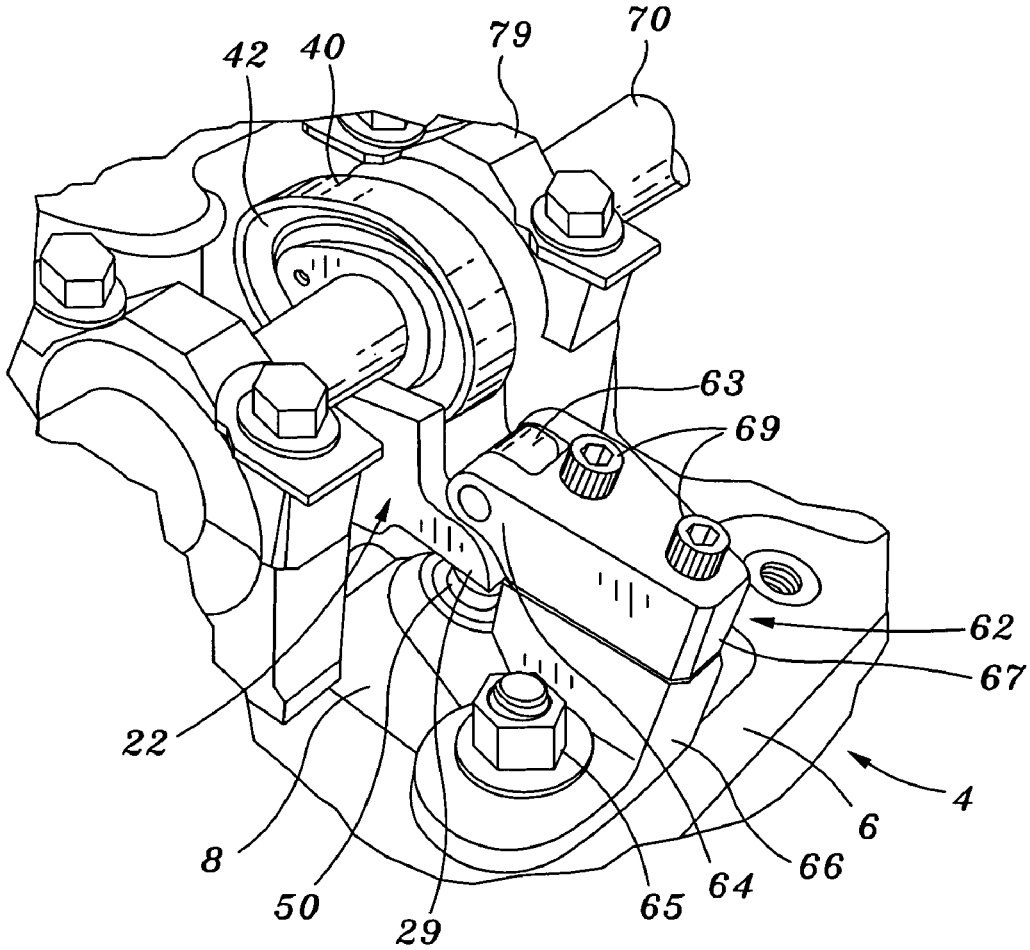
FIG. 10 shows a perspective view of the first embodiment of a rocker roller retainer bracket from FIG. 9, according to an aspect of the present invention.

FIG. 10 shows a perspective view of the first embodiment of a rocker roller retainer bracket 62 from FIG. 9, according to an aspect of the present invention. It is noted that since the first embodiment of rocker roller retainer bracket 62 is mounted to the upper surface of the head 39, it may be fastened to the head using the conventional head bolt positions. It is further noted that in this configuration of the present invention, the stock conventional upper cam bearing journal caps 61 are utilized to secure the main camshaft 70 into the head 4.

Figure 11:
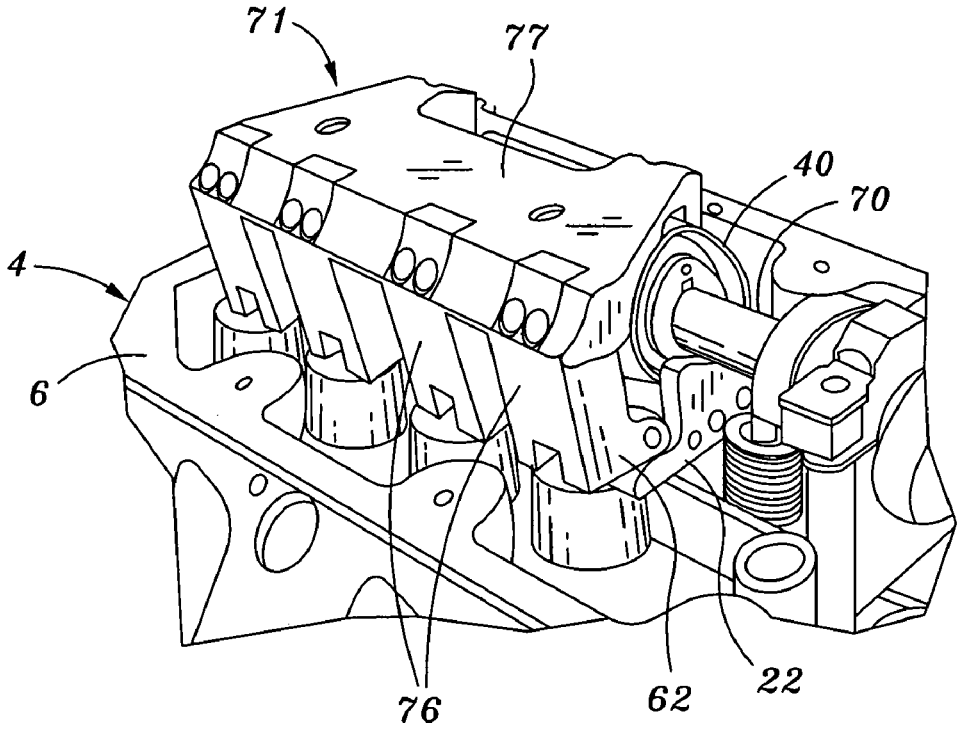
FIG. 11 shows a perspective view of a second embodiment of a rocker roller retainer bracket assembly which is adapted to be mounted directly above the main camshaft, wherein the roller retainer is positioned such that is supported overhead by the bracket assembly, according to an aspect of the present invention.
Figure 12:
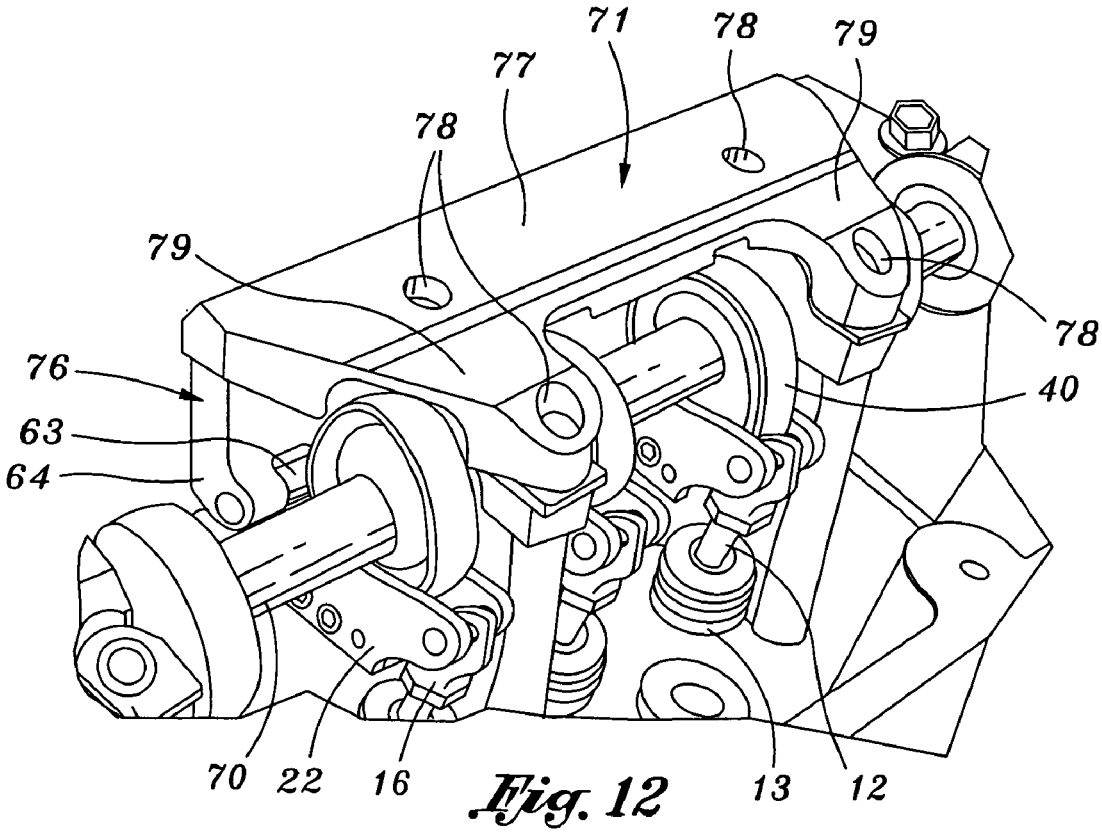
FIG. 12 shows another perspective view of the second embodiment of a rocker roller retainer bracket assembly from FIG. 10, according to an aspect of the present invention.

FIG. 11 shows a perspective view of a second embodiment of a rocker roller retainer bracket assembly 71 which is adapted to be mounted directly above the stock conventional upper cam bearing journal caps 61 instead of using the conventional head bolt positions as is done with the first embodiment of the rocker roller retainer bracket 71; while FIG. 12 shows another perspective view of the second embodiment of a rocker roller retainer bracket assembly from FIG. 10, according to an aspect of the present invention. The second embodiment 71 is provided as an alternative to the first embodiment to avoid having to remove the head bolts. As can be seen from FIGS. 11 and 12, the bracket assembly 71 includes a plurality of downwardly projecting roller retainer brackets 76 (one assigned for each hydraulic lifter 50) which are attached to a main upper bracket 77. The details of the second embodiment of a rocker roller retainer bracket assembly 71 are now herein discussed in further detail below.

Figure 13:
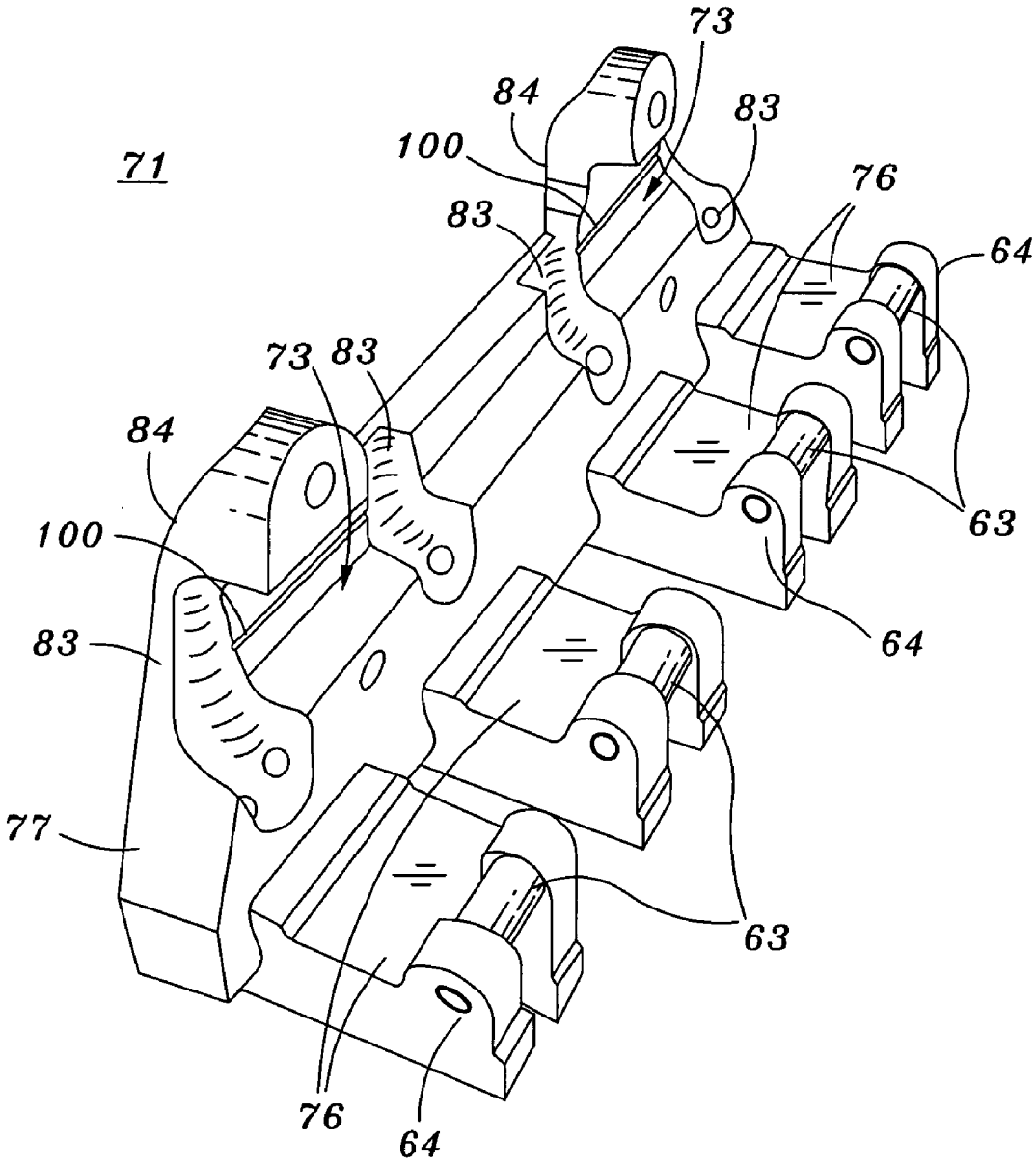
FIG. 13 shows another perspective view of the second embodiment of a rocker roller retainer bracket assembly from FIG. 10 removed from the engine, according to an aspect of the present invention.

FIG. 13 shows another perspective view of the second embodiment of a rocker roller retainer bracket assembly 71 from FIGS. 11 and 12 removed from the engine, according to an aspect of the present invention. The exemplary bracket 71 includes a main upper bracket member 77 and a plurality of downwardly projecting roller retainer brackets 76. Each retainer bracket 76 includes a distal arm which is adapted to have a roller 63 integrated thereto. It is noted that main upper bracket member 77 is adapted to include a plurality of journal mounts 84 which have voids 73 internally formed therein such that the bracket assembly 71 may be mounted directly over the stock journal caps 47, 48. Further, it is noted that main upper bracket member 77 is also adapted to include a plurality of cam clearance voids 83 formed therein such that the cam lobes 40 have sufficient clearance for operation. Also, the bracket member 77 includes mounting holes 78 which are utilized to mount the bracket member 77, using the stock mounting holes for the journals 47, 48.

It is additionally noted that the rocker roller retainer bracket assembly 71 described above should not be limited to the exemplary embodiment shown in FIGS. 11–13, rather rocker roller retainer bracket 71 is merely an example of one of several envisioned ways the roller 63 may be properly positioned above and in contact with the hydraulic lifter connecting end 29. Therefore, the present invention should not be limited to the structural details of specific example of the rocker roller retainer bracket assembly 71 shown in FIGS. 11–13.

Adjustability and Cam Tuning Features

Another one of the aspects of the present invention is that the cam lobe assemblies 40 may have varying profiles (or "grinds"), thereby, allowing the duration (i.e., how rapidly or quickly the valve 10 is opened and closed). That is to say, since the present invention 2 is designed such that the cam assemblies 40 may be removed and replaced, this allows one to install cam assemblies 40 with varying following groove 42 shapes for tuning purposes. Moreover, another aspect of the present invention is that the cam gear 74 may be radially "clocked" or mounted at varying positions to cam gear hub 80 to either advance the timing or to retard the timing.

Oiling System

Another aspect of the present invention includes oiling system features. For instance, as shown in FIGS. 6 and 7 a circumferential oiling groove 98 may disposed on the end collar 96 such that oil may be circulated underneath the main cam journal 48. Furthermore, as shown in FIG. 8, oil ports 99 are disposed through the main cam journals 48 and oil ports 97 are disposed through the inner cam journals 47. Additionally, circumferential oiling grooves may also be disposed around end bearing journal hubs 90. Also, oil distribution grooves 100 may be formed voids 73 formed in the rocker roller retainer bracket assembly 71.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed; rather, the invention extends to all functionally equivalent structures, methods, and such uses are within the scope of the appended claims.

What is claimed is:

1. A desmodromic "springless" valve and adjustable cam system adapted to be installed onto a head configured for an overhead cam for an internal combustion engine having at least one intake and one exhaust valve per cylinder, the system comprising:

a main camshaft adapted to be positioned within a plurality of bearing journals transversely positioned and spaced along a longitudinal length of the head;

a cam lobe assigned to each valve, each cam lobe adapted to be installed onto the main camshaft, each cam lobe defined by first and second opposing sides, a perimeter edge, a mounting hole disposed through the first and second sides in a normal orientation, and a follower groove formed in each side of the cam which is representative of a desired cam duration;

at least one intake and one exhaust valve assigned to each cylinder, each valve adapted to be received within a respective valve guide disposed within the head, each valve having a valve stem with a distal connecting tip exposed above the head;

a valve connector installed onto the distal tip of each valve;

a hydraulic lifter assigned to each valve which is adapted to be received within a lifter seat disposed within the head, each lifter including a moveable piston within, the piston having piston tip which is exposed above the head;

a rocker defined by a valve movement end and lifter end, the valve movement end adapted to be mechanically linked to a respective valve connector and the lifter end adapted to be pressed against a respective piston tip; and a rocker retainer adapted to maintain the lifter end of the rocker depressed against the piston tip of the hydraulic lifter;

wherein when the main camshaft rotates, the valve movement end of the rocker moves in manner which results in each valve being moved upwards and downwards as a function of the cam duration and lift, thereby opening and closing each respective valve.

2. The desmodromic valve and adjustable cam system according to claim 1, wherein the hydraulic lifters automatically adjust valve lash for each valve.

3. The desmodromic valve and adjustable cam system according to claim 1, each rocker comprising, a first and second rocker half adapted to be sandwiched together such that a portion of a respective cam lobe may be movably received between both halves, and a connecting pin rigidly attached to each rocker half in a normal orientation such that each pin is received within the following grooves formed in each side of the respective cam.

4. The desmodromic valve and adjustable cam system according to claim 1, further including, a valve keeper fitting having a bore disposed there through for receiving the valve stem, the keeper fitting further including, an upper portion having a frustro-conical shaped seat formed therein and conventional male threads formed external thereto; and a lower portion having a flange adapted to be received by a tool; and a pair of frustro-conically shaped valve keepers;

wherein each valve has at least one radial groove formed on the valve stem for receiving the pair valve keepers;

wherein the keeper fitting is adapted to be installed into a lower end of the valve connector such that the pair of valve keepers are received into the frusto-conical shaped seat and maintained by a compression fit.

5. The desmodromic valve and adjustable cam system according to claim 2, further including a coil spring positioned between the distal tip of the valve stem and the valve connector for dampening shock imparted to the valve.

6. The desmodromic valve and adjustable cam system according to claim 1, the hydraulic lifter further comprising, a generally cylindrically-shaped lifter body having a first cylindrical cavity disposed therein which is adapted to receive the moveable piston;

a coil spring concentrically retained internally within the piston such that it is biased between a spring retainer within the piston and a lower backing surface of the lifter body; and an oil passage disposed through the lifter body for directing oil into the hydraulic lifter;

wherein oil is fed into the lifter from an oil supply line disposed within the cylinder head;

wherein the lifter acts as a dampener that maintains a constant, yet adjustable tension, to the rocker.

7. The desmodromic valve and adjustable cam system according to claim 3, the valve connector comprising, a valve connecting fitting defining a cap having female threads internally formed therein which are adapted to receive the upper portion of the valve keeper fitting, the fitting having formed internally therein a valve tip seat which is adapted to receive the distal tip of the valve stem; and a rocker connecting end which includes a receiving slot which is adapted to slidably and rotatably receive the connecting pin from the follower rocker.

8. The desmodromic valve and adjustable cam system according to claim 1, further comprising a cam gear attached to a first end of the main camshaft, wherein the cam gear is adapted to be via a chain which is driven from a crankshaft of the engine.

9. The desmodromic valve and adjustable cam system according to claim 8, further comprising a cam gear hub which interconnects the cam gear to the main camshaft.

10. The desmodromic valve and adjustable cam system according to claim 9, wherein timing of the system may be one of advanced or retarded by radially clocking the cam gear with respect to the cam hub.

11. The desmodromic valve and adjustable cam system according to claim 8, further comprising a pair of end journal bearing hubs attached to the main camshaft, the pair including a first journal hub positioned proximate the cam gear, and a second journal hub positioned proximate a second end of the main camshaft, wherein the journal bearing hubs are adapted to be received by end journals of the head.

12. The desmodromic valve and adjustable cam system according to claim 1, the mounting hole of each cam lobe having a cam lobe key receiving slot formed along a length of the mounting hole; and the main camshaft having a camshaft key receiving slot disposed in an exterior surface of the shaft for each respective cam lobe;

wherein a key is installed into the cam lobe key receiving slot for each cam lobe and a respective camshaft key receiving slot assigned to each respective cam lobe for rigidly securing the cams lobes to the main camshaft.

13. The desmodromic valve and adjustable cam system according to claim 1, further comprising a plurality of cam lobe assembly kits adapted to be installed and removed onto the main camshaft, wherein each kit provides a differing cam profile offering a unique set of tuning characteristics for each respective kit.

14. The desmodromic valve and adjustable cam system according to claim 1, wherein the main camshaft is adapted to be retained within the plurality of bearing journals by utilizing conventional journal caps.

15. The desmodromic valve and adjustable cam system according to claim 1, the rocker retainer comprising a rocker roller retainer bracket having a distal arm with a roller transversely integrated into the distal arm, wherein the roller is positioned such that it is maintained in contact with an upper surface of the lifter end of the rocker.

16. The desmodromic valve and adjustable cam system according to claim 15, the rocker roller retainer bracket adapted to be mounted to the upper surface of the head.

17. The desmodromic valve and adjustable cam system according to claim 15, the rocker roller retainer bracket adapted to be mounted directly over conventional journal caps utilized to retain the main camshaft within the plurality of bearing journals.

18. The desmodromic valve and adjustable cam system according to claim 1, the valve connector comprising, a main valve connector body adapted to be connected to the distal tip of the valve, the body defined by a center axis, a lower end having a radial flange with a hole disposed therethrough for receiving the upper end of the valve, an upper end having a pair of opposing yokes arms projecting upwards, each arm having a pin receiving hole, and an internal cavity disposed through the body about the center axis from the upper end and terminating within the body to form a backside of the radial flange about the center axis;

a first connecting pin installed into the pin receiving holes of the yoke arm;

a linking member having a pair pin receiving holes, the linking member being rotatably connected to the second connecting pin via one of the pin receiving holes and further rotatably connected to the valve connector pin disposed on the valve movement end of the rocker via the other pin receiving hole.

19. The desmodromic valve and adjustable cam system according to claim 18, the valve connector further comprising, at least one first wave washer adapted to be received by the valve stem, the first wave washer being positioned adjacent the backside of the radial flange;

a pair of frustro-conically shaped valve keepers adapted to be received by at least one radial groove formed on the valve stem for receiving the pair of valve keepers, the valve keepers being positioned over the at least one first wave washer;

at least one second wave washer adapted to be received by the valve stem, the second wave washer being positioned over the valve keepers; and at least one locking retainer adapted to be received by the valve stem, the at least one locking retainer positioned over the at least one second wave washer.

* * * * *